US006964634B2

(12) United States Patent
Wojtkiewicz et al.

(10) Patent No.: US 6,964,634 B2
(45) Date of Patent: Nov. 15, 2005

(54) JUMPING DEVICE WITH CONVERTIBLE STABILIZING BASE

(75) Inventors: Mark Wojtkiewicz, Lancaster, NY (US); David E. Grober, East Aurora, NY (US); David G. Waples, Orchard Park, NY (US)

(73) Assignee: Mattel, Inc., El Segundo, CA (US)

( * ) Notice: Subject to any disclaimer, the term of this patent is extended or adjusted under 35 U.S.C. 154(b) by 134 days.

(21) Appl. No.: 09/976,837

(22) Filed: Oct. 15, 2001

(65) Prior Publication Data

US 2003/0073547 A1 Apr. 17, 2003

(51) Int. Cl.[7] ..... A63B 26/00
(52) U.S. Cl. ..... 482/77
(58) Field of Search ..... 482/77, 87, 89, 482/75–76, 121–123; D21/415

(56) References Cited

U.S. PATENT DOCUMENTS

| | | | | |
|---|---|---|---|---|
| 1,037,503 A | | 9/1912 | Mann | |
| 2,172,645 A | | 9/1939 | Taylor | |
| 2,510,509 A | | 6/1950 | Mays | |
| 2,793,036 A | | 5/1957 | Hansburg | |
| 2,995,377 A | * | 8/1961 | Miihlroth | 280/1.13 |
| 2,997,300 A | | 8/1961 | House | |
| 3,110,492 A | | 11/1963 | Hoffmeister | |
| 3,273,575 A | | 9/1966 | Aldrich | |
| 3,298,686 A | | 1/1967 | Hansburg | |
| 3,328,028 A | | 6/1967 | Williams | |
| 3,626,519 A | | 12/1971 | Baker | |
| 3,627,314 A | | 12/1971 | Brown | |
| 3,671,988 A | * | 6/1972 | Newman | 441/65 |
| 3,731,920 A | * | 5/1973 | Matsuda | 482/77 |
| 3,735,980 A | | 5/1973 | Weiss | |
| 3,977,094 A | | 8/1976 | Rivera et al. | |
| 4,390,178 A | | 6/1983 | Rudell et al. | |
| 4,526,036 A | | 7/1985 | Morrison | |
| 4,605,224 A | | 8/1986 | Torii | |
| 5,009,415 A | | 4/1991 | Perez Blanco | |
| 5,087,037 A | | 2/1992 | Morrow | |
| 5,112,045 A | | 5/1992 | Mason et al. | |
| 5,628,713 A | | 5/1997 | Wilkinson | |
| 5,713,819 A | | 2/1998 | Hsieh | |

(Continued)

FOREIGN PATENT DOCUMENTS

FR 1 252 166 12/1960

OTHER PUBLICATIONS

Sport Fun web page printed Jun. 7, 2001 (2 pages) advertising the Kid Starts! Pogo Jammer, Pogo–Roo, and Pogo–Roo Jr. products from http://www.sportfun.com/kid-starts/pogo/pogo.htm.

Chris Adams, "Pogo Sticks Bounce Back," p. 23, *The Toy Book*, Oct. 2001.

Sport Fun web page printed Oct. 30, 2001 (1 page) advertising the Rawlings Electronic Pogo Stick product from http://www.sportfun.com/rawlings/other/pogo–disc.htm.

Sport Fun web page printed Oct. 30, 2001 (2 pages) advertising the Kid Starts! Pogo Jammer, Pogo–Roo, and Pogo–Roo Jr. products from http://www.sportfun.com/kid-starts/pogo/pogo.htm.

My First Pogo Roo Advertisement (1 page), Item #1313 from Sport–Fun, Copyright 2002.

*Primary Examiner*—Jerome W. Donnelly
*Assistant Examiner*—Fenn C. Mathew
(74) *Attorney, Agent, or Firm*—Cooley Godward LLP

(57) ABSTRACT

A base releasably coupleable to a pogo stick tip for added stability and prolonged enjoyment of the pogo stick.

27 Claims, 15 Drawing Sheets

U.S. PATENT DOCUMENTS 5,788,608 A * 8/1998 Wilkinson ..... 482/51
5,853,329 A 12/1998 Worlds et al.
5,857,939 A 1/1999 Kaufman
5,897,474 A 4/1999 Romero
5,899,835 A * 5/1999 Puranda ..... 482/90
5,992,434 A * 11/1999 Berlin et al. ..... 135/77
6,126,578 A 10/2000 Lapointe
6,131,593 A * 10/2000 Greene et al. ..... 135/77
6,168,555 B1 1/2001 Fetterleigh et al.
6,503,177 B2 * 1/2003 Herman ..... 482/77

* cited by examiner

JUMPING DEVICE WITH CONVERTIBLE STABILIZING BASE

BACKGROUND

1. Field of the Invention

The present invention relates generally to stabilizer bases for jumping devices, and more particularly, to releasably coupleable bases for pogo sticks.

2. Discussion of Related Art

Conventional jumping devices, such as pogo sticks have been in existence for some time and provide a distinct challenge to children, particularly young children, when operated. To operate a pogo stick, a child generally steps onto a foot-rest mounted to a housing, grasps a handle on the housing, and hops through successive iterations to progressive positions until the child loses his or her balance. It is a challenge for children to be able to hop on the pogo stick through a number of successive iterations without having to jump off the pogo stick because of a loss of balance.

The challenges presented by conventional pogo sticks are amplified for children of a young age. Many young children cannot balance on the small base of a conventional pogo stick and therefore cannot partake in the physical and entertainment value that pogo sticks present.

In some conventional applications, pogo sticks have been provided with a larger base mounted directly to the end of the pogo stick housing. Such applications, however, do not afford the child the opportunity to use a pogo stick with a conventional small base once the child has obtained control over his or her balance. In order to move up to that level, parents or caregivers have had to purchase a new pogo stick.

Other conventional pogo sticks have been provided with a number of interchangeable bases. However, these have been complex or cumbersome. A need exists for a stabilizer or base that can be releasably coupled to a conventional pogo stick to enable a young child to play with the pogo stick while the child is developing his or her balance. A need also exists for an interchangeable base that can be easily attached and removed from the pogo stick once the child has developed enough skills to be able to use a conventional pogo stick base.

SUMMARY OF THE INVENTION

The present invention solves the problems with, and overcomes the disadvantages of, conventional bases for jumping sticks. In particular, the present invention provides a base that can be releasably coupled to a pogo stick tip. In one embodiment, the base includes a ground engaging portion that is disposed at or below a lower surface of the tip when the base and the tip are coupled together. The ground engaging portion is engageable with a ground surface at a plurality of contact points spaced laterally from an axis of the pogo stick housing or tubular members, or alternatively, from an axis of the pogo stick tip. In an alternative embodiment, the invention includes a pogo stick with a first and second tubular member, a handle, a foot rest, a tip, and a stabilizer releasably coupled to the tip.

DETAILED DESCRIPTION

Figure 1:
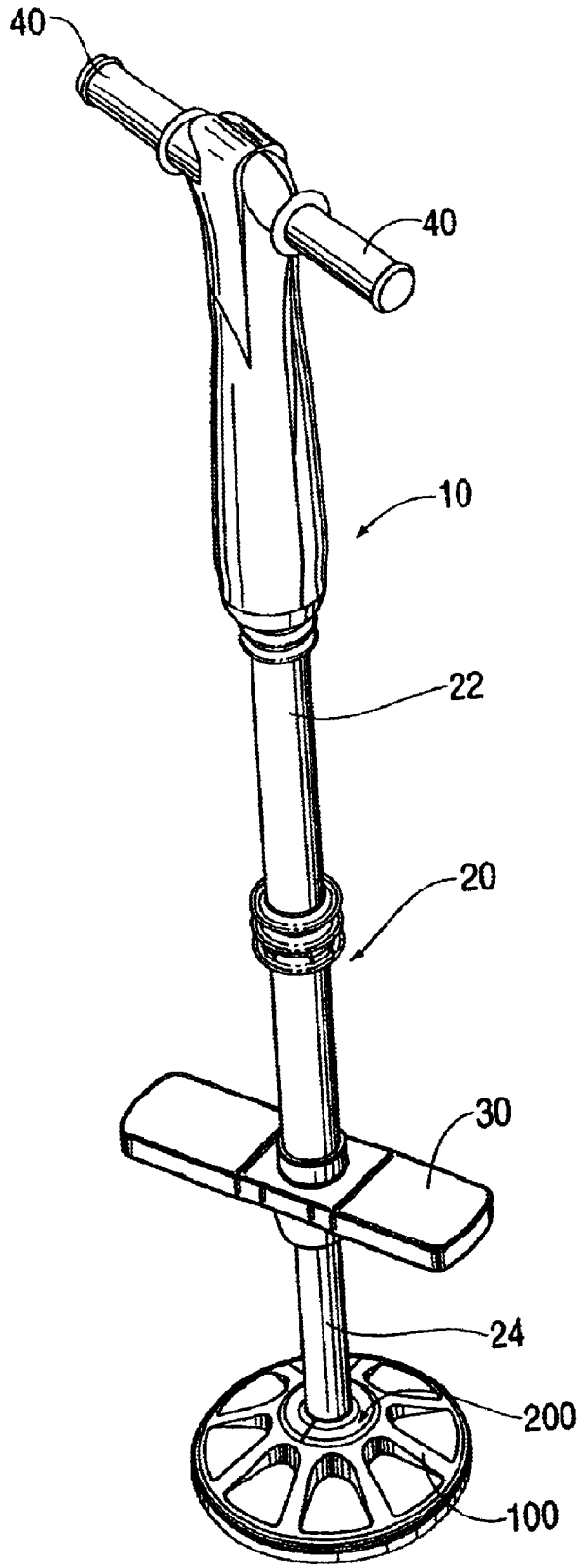
FIG. 1 is a perspective view of one embodiment of a pogo stick structure embodying the principles of the invention.

A pogo stick structure 10 according to an embodiment of the invention is illustrated in FIG. 1. Pogo stick structure 10 includes a housing or tubular frame 20. Frame 20 includes a first elongate tubular member 22 and a second elongate tubular member 24. Tubular member 22 and 24 can alternatively be referred to as a rod, post, or pole.

Tubular member 24 is disposed parallel to and concentric with tubular member 22 and is adapted for axial movement relative to tubular member 22. Tubular member 24 can be formed integrally with tubular member 22 or can be coupled to tubular member 22. In addition tubular member 24 can be disposed within tubular member 22. Alternatively, tubular member 22 can be disposed within tubular member 24. A spring (not shown) or other compression mechanism is disposed within tubular frame 20.

Secured to tubular member 22 is a footrest 30 on which a user rests his or her feet when jumping on the stick 10. Alternatively, foot rest 30 can be secured to tubular member 24. A pair of handles 40 is disposed at an upper portion of tubular member 22. Handles 40 can be formed integrally with tubular member 22 are can be attached to tubular member 22 using any conventional attaching mechanisms.

The pogo stick structure 10 also includes a base assembly including a second ground engaging member 100 disposed at a lower end of the pogo stick structure 10. Second ground engaging member 100 can be alternatively referred to as a stabilizer or base 100. The pogo stick structure 10 also includes a coupler 200, which is used to releasably couple base 100 to tip 50.

Figure 2A:
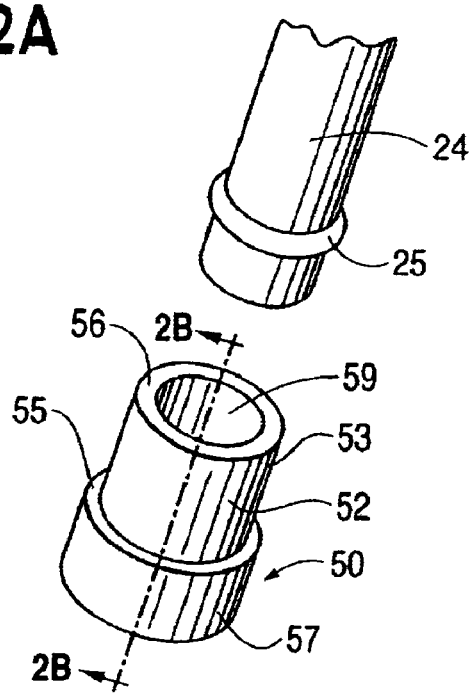
FIG. 2A is an exploded perspective view of one embodiment of a pogo stick tip and tubular member usable with the pogo stick structure of FIG. 1.

Referring to FIG. 2A, the pogo stick structure 10 also includes a first ground engaging member or tip 50. The tip 50 is releasably coupleable to a lower end of tubular member 24. Tip 50 can be formed of rubber or other resilient material. In the illustrated embodiment, tip 50 includes a body portion 52 having an upper body portion 53 having a first diameter and a lower body portion 57 having a second diameter. Body portion 52 includes a lower surface 54 and an upper surface 56. As shown in FIG. 2A, the diameter of lower body portion 57 is larger than the diameter of upper body portion 53 such that a lip or ledge 55 is formed at the intersection of the upper body portion 53 and the lower body portion 57. Body portion 52 includes an opening 59 formed therethrough and configured to receive tubular member 24.

Figure 2B:
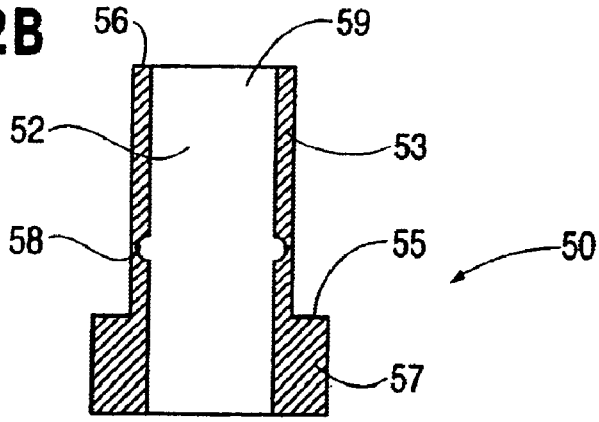
FIG. 2B is a cross-sectional side view of the pogo stick tip of FIG. 2A taken along lines "2B—2B" of FIG. 2A.

As illustrated in FIG. 2A, tubular member 24 includes a raised ring portion or coupling member 25 disposed about a portion of the outer surface of tubular member 24. Coupling member 25 is formed integrally with tubular member 24. Alternatively, coupling member 25 can be formed separately and coupled to tubular member 24. Coupling member 25 engages a corresponding annular recess or cavity 58 formed on an inner surface of body portion 52, as can be seen in FIG. 2B. In operation, as tubular member 24 is inserted into opening 59, coupling member 25 slides along the inner wall of opening 59 until it reaches cavity 58. At this point, coupling member 25 engages cavity 58 to couple tip 50 and tubular member 24 together.

Figure 2C:
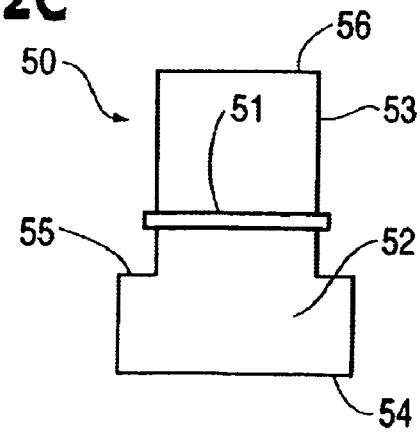
FIG. 2C is a side view of an alternative embodiment of the pogo stick tip usable with the pogo stick structure of FIG. 1.

An alternative tip usable with the pogo stick structure 10 of FIG. 1 is illustrated in FIG. 2C. As shown in FIG. 2C, tip 50 includes a body portion 52. Body portion 52 includes a lip or ledge 55 formed at a lower end of body portion 52. An annular ring 51 is disposed on body portion 52. Ring 51 can be formed integrally with body portion 52 or can be coupled to a slot or groove formed in an outer surface of body portion 52.

Figure 3:
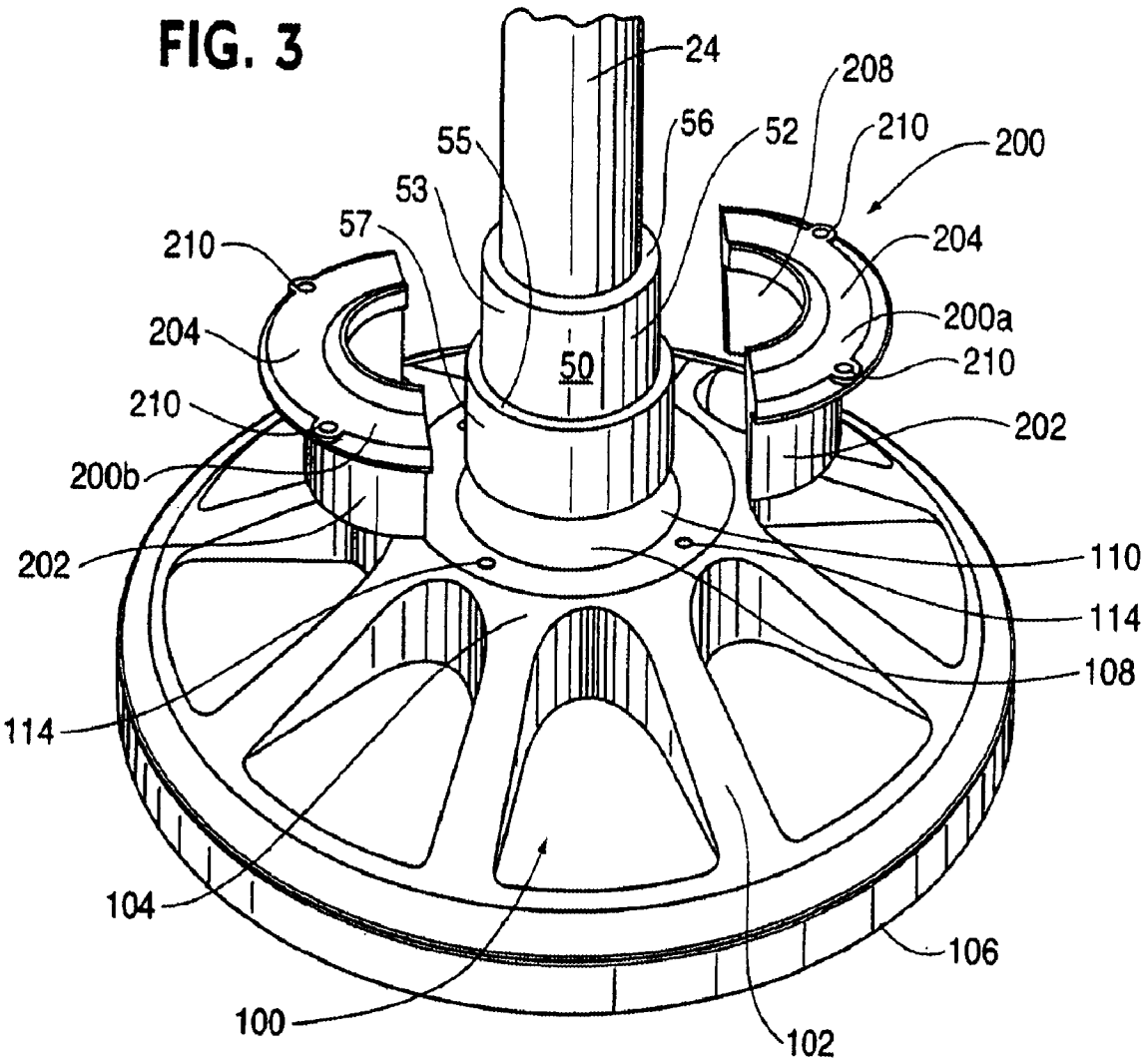
FIG. 3 is an exploded perspective view of the base assembly of the pogo stick structure of FIG. 1.
Figure 4:
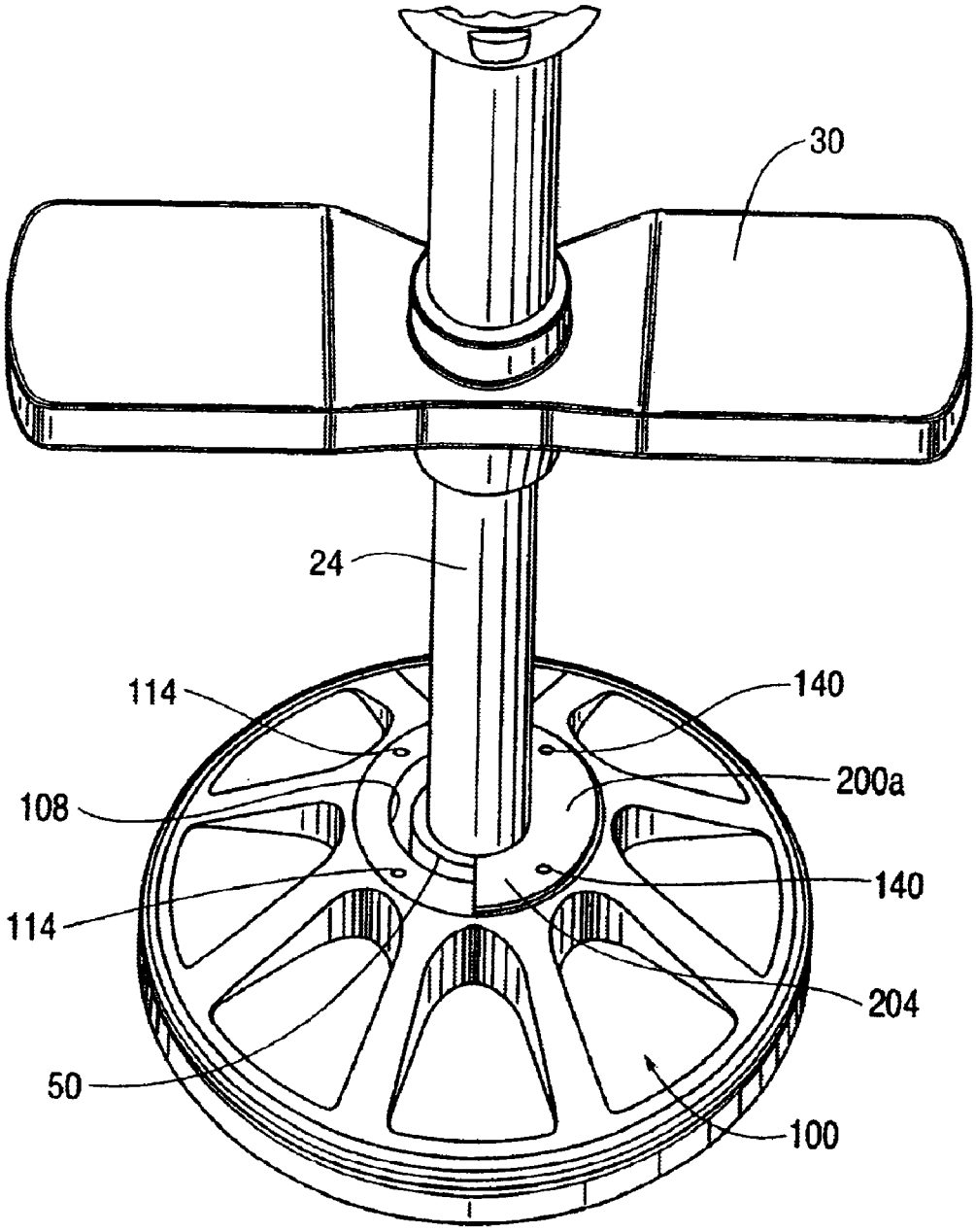
FIG. 4 is a partial assembled perspective view of the base assembly of FIG. 3.
Figure 5:
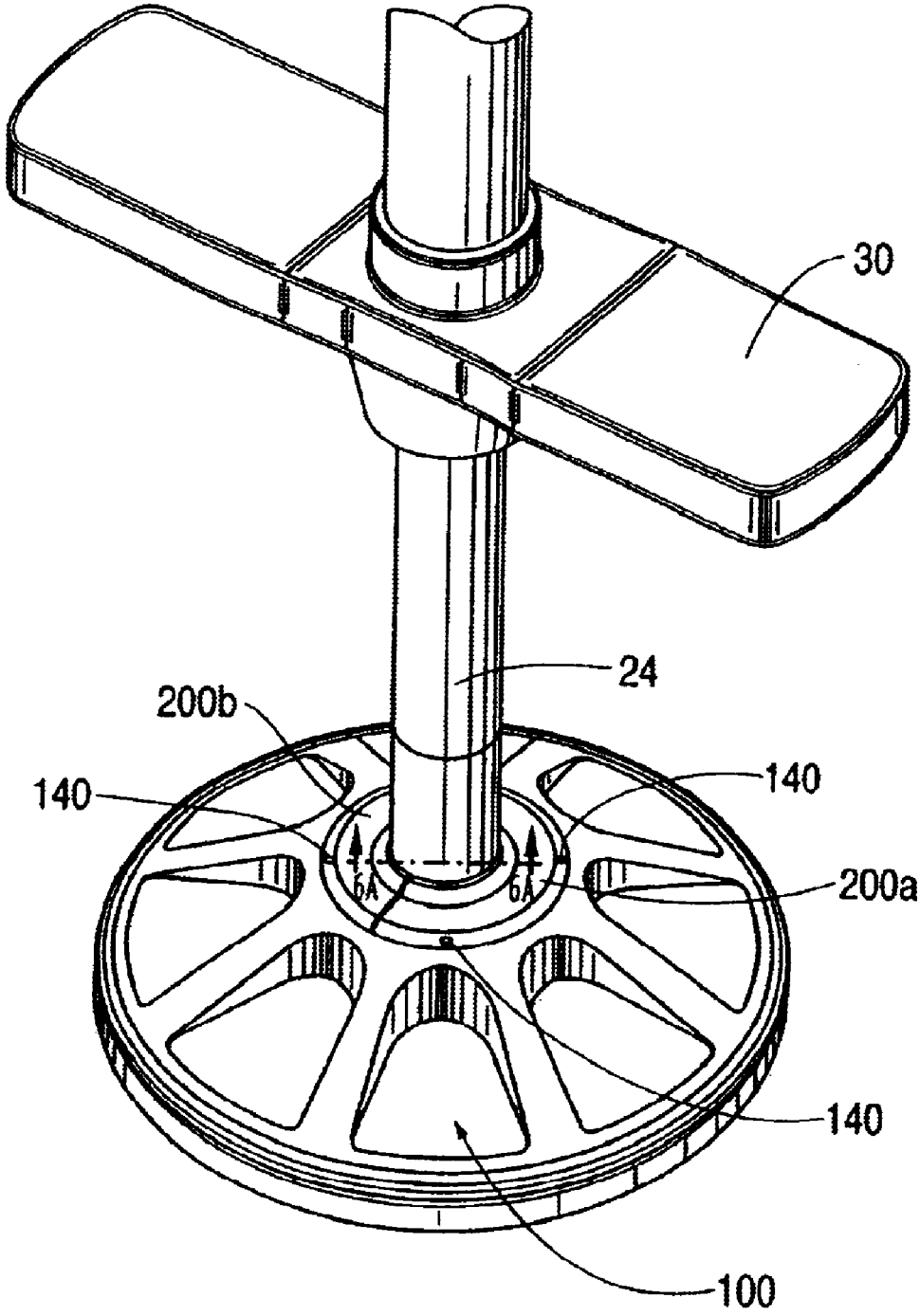
FIG. 5 is an assembled perspective view of the base assembly of FIG. 3.

An embodiment of the base assembly of FIG. 1 is illustrated in FIG. 3. As illustrated in FIG. 3, base 100 includes a body portion 102 having an upper surface 104 and a lower ground engaging surface 106. An opening 108 is disposed in upper surface 104. Opening 108 is dimensioned such that tip 50 can be received in opening 108. Opening 108 is formed with a side wall portion 110 and a bottom portion (not shown). Alternatively, the opening 108 can be formed with the sidewall portion 110 but without the bottom portion. In this configuration, the opening 108 extends from the upper surface 104 to the lower surface 106 or adjacent the lower surface 106. Base 100 includes mounting holes 114 disposed in upper surface 104. Any suitable number of mounting holes 114 can be employed in the invention.

The base assembly includes a coupler 200. As shown in FIG. 3, coupler 200 includes two portions 200*a* and 200*b*. Alternatively, coupler 200 could be formed in a one-piece configuration. Coupler portions 200*a* and 200*b* include a body portion or sleeve portion 202 and a rim, edge, or lip 204 formed about one end of sleeve or body portion 202. A portion of lip 204 is configured to engage the upper surface 56 of tip 50. Lip 204, however, is not required to engage the upper surface 56 of the tip 50. In an alternative embodiment, coupler 200 can be attached or coupled to tubular member 24 and configured or adapted to enclose tip 50. Body portion 202 includes an outer surface 206 and an inner surface 208.

Each of coupler portions 200*a* and 200*b* also includes mounting holes 210 adapted or configured to mate with mounting holes 114 in the upper surface 104 of base 100. A screw or other conventional fastening mechanism can be used to releasably couple coupler 200 to base 100 through mounting holes 210 and 114. Alternatively, coupler 200 and base 100 could be releasably coupled together using any conventional fastening technique or mechanism.

As illustrated in FIG. 3, the base 100 has a frustum-conical shape and lower ground engaging surface 106 has a circular, substantially flat ground-engaging surface. In alternative embodiments, base 100 can be formed in any suitable shape or combination of shapes, such as a pyramid, box, cylinder, or the like. In further alternative embodiments, lower ground engaging surface 106 can be formed in a number of different configurations or geometries as will be discussed in more detail below.

Figure 6A:
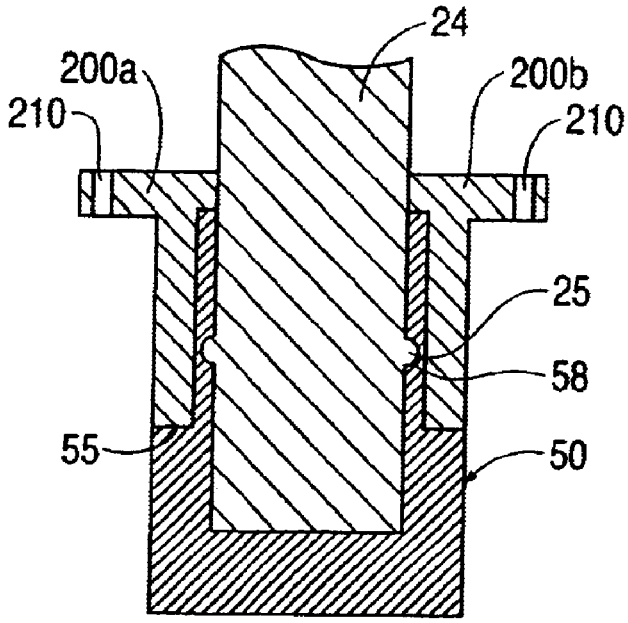
FIG. 6A is a partial cross-sectional side view of the assembled base assembly of FIG. 5 employing the tip of FIGS. 2A—2B taken along lines "6A—6A" of FIG. 5.

An implementation of the releasable coupling mechanism between base 100, coupler 200 and the tip of FIGS. 2A–2B is illustrated in FIGS. 4–6A. In the illustrated implementation, tip 50 is inserted into opening 108. Once the tip 50 is inserted into the opening 108, then coupler section 200*a* is positioned above and aligned with opening 108 in base 100 and placed into opening 108 until the bottom surface of section 200*a* engages the ledge 55 of tip 50 as illustrated in FIG. 6A.

Following placement of coupler section 200*a* into opening 108, coupler section 200*b* is positioned above and aligned with opening 108 and placed into opening 108 until the bottom surface of section 200*b* engages the ledge 55 of tip 50. As coupler sections 200*a* and 200*b* are inserted into the opening 108, the inner surface 208 contacts the outer surface of the upper portion 53 of tip 50. In the illustrated embodiment, the bottom surface of lip 204 also engages the upper surface 56 of tip 50. Alternatively, the bottom surface of lip 204 does not engage the upper surface 56 of tip 50. Once the coupler sections 200*a* and 200*b* are placed into the opening 108, they can be releasably coupled to base 100 using screws 140 or other suitable fasteners.

Figure 6B:
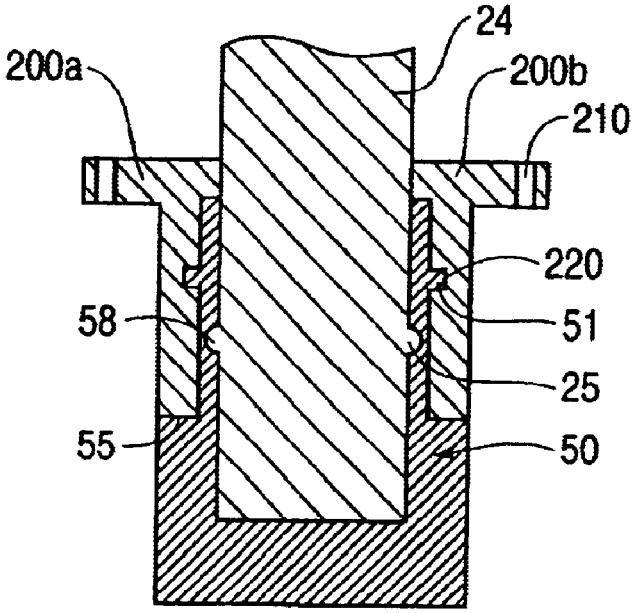
FIG. 6B is a partial cross-sectional side view of an alternative embodiment of the assembled base assembly of FIG. 5 employing the tip of FIG. 2C.

An alternative implementation of the releasable coupling between base 100, coupler 200 and the tip of FIG. 2C is illustrated in FIG. 6B. In the illustrated embodiment, coupler portions 200*a* and 200*b* include a slot or groove 220 formed on the inner surface of coupler portions 200*a* and 200*b*. Coupler sections 200*a* and 200*b* are positioned around tip 50 such that the annular ring 51 engages the corresponding groove 220. Coupler sections 200*a* and 200*b*, and tip 50, are then inserted into the opening 108 of base 100. Coupler sections 200*a* and 200*b* can then be coupled to base 100 by placing screws through openings 210.

Figure 7:
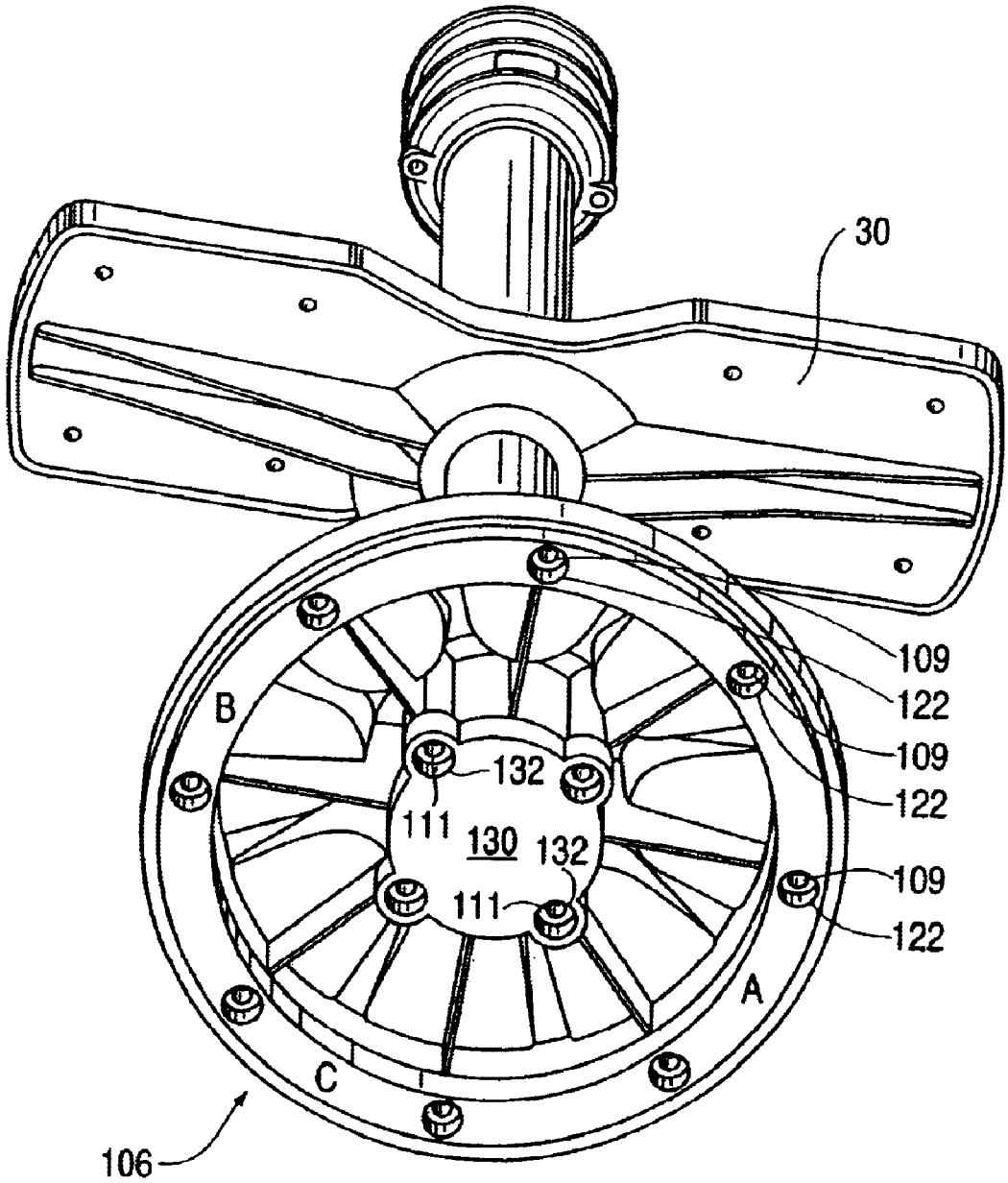
FIG. 7 is a bottom perspective view of the base of the pogo stick structure of FIG. 1.

An embodiment of the lower ground engaging surface 106 of base 100 is shown in FIG. 7. Surface 106 includes a ground engaging member or pad 120 which is coupled around a perimeter of lower surface 106 using screws or other conventional fastening mechanisms through holes 122 and mating openings 109 formed in base 100. Alternatively, pad 120 can be coupled to base 100 and more particularly lower surface 106 using adhesives, such as glue and the like. Pad 120 can have a substantially circular, square, or flat cross-sectional area. Alternatively, pad 120 can be formed in any suitable geometric configuration. In the illustrated embodiment, pad 120 is made from rubber or other suitable elastic material. In an alternative embodiment, ground engaging surface 106 includes a plurality of individual pads 120. Each of the plurality of individual pads 120 is coupled to surface 106.

As illustrated in FIG. 7, an additional ground engaging member or pad 130 is also coupled to a central region of lower surface 106. Central pad 130 is coupled to lower surface 106 by placing screws or other conventional fastening mechanisms through mounting holes 132 and mating openings 111 formed in base 100. In an alternative embodiment, pad 130 can be coupled to lower surface 106 using adhesives and the like. In the illustrated embodiment, pad 130 is made from rubber or other suitable elastic material. In a further alternative embodiment, lower surface 106 does not include pad 130.

The lower ground engaging surface 106 is provided with a number of ground engaging contact points, for example, "A," "B," and "C" spaced laterally from the longitudinal axis of the tubular frame 20, and more specifically the longitudinal axis of tip 50. Having a number of ground engaging contact points spaced laterally from the longitudinal axis of the tubular member 20 and the tip 50 increases the stability of the pogo stick structure 10 while in use.

In addition, the lower ground engaging surface 106 is disposed at or below the lower surface of tip 50 when base 100 is coupled to tip 50. This ensures that the plurality of ground engaging contact points on the lower surface 106 contact the ground prior to the lower surface of tip 50 to provide added stability to the device.

Figure 8:
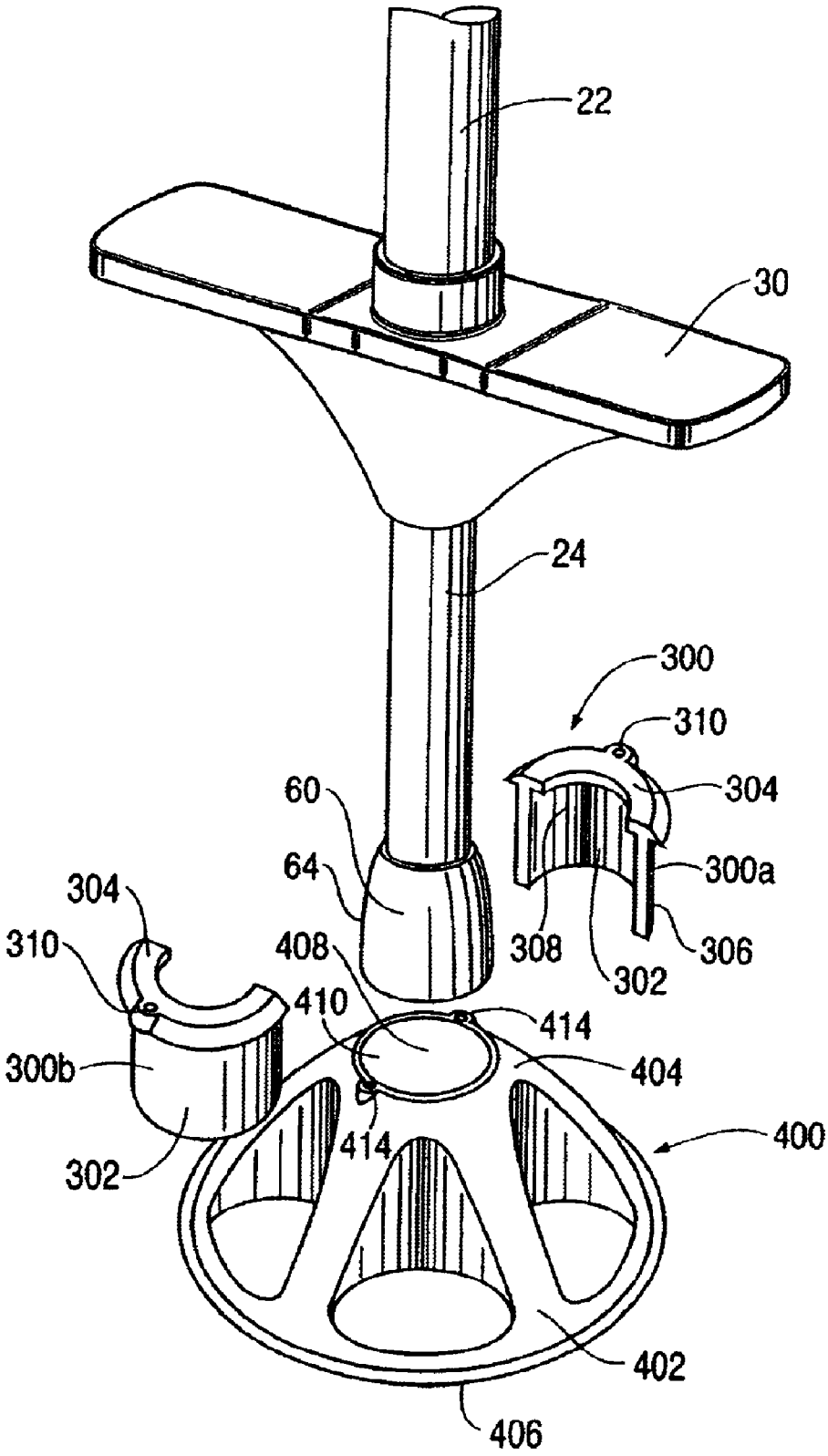
FIG. 8 is an exploded perspective view of an alternative embodiment of a base assembly embodying the principles of the invention.
Figure 9:
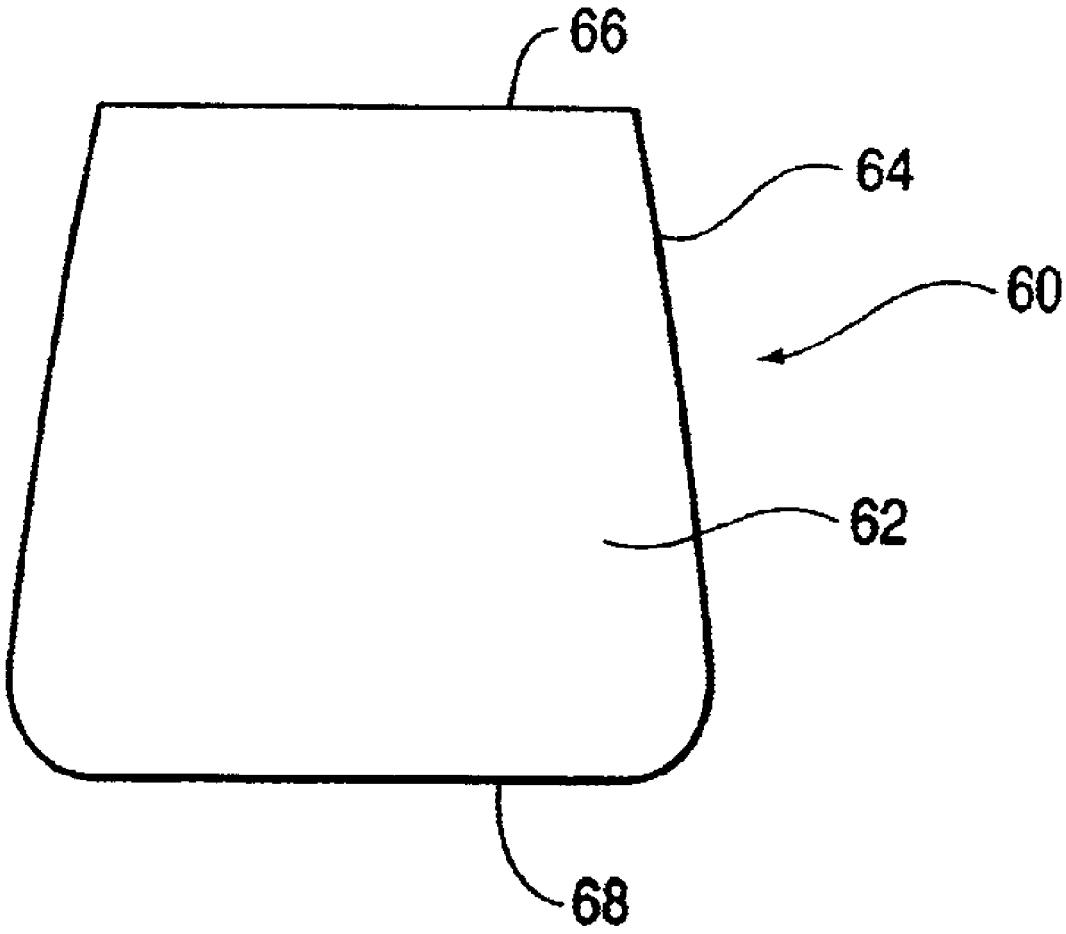
FIG. 9 is a side view of the pogo stick tip of FIG. 8.

An alternative embodiment of a base, tip, and coupler, or base assembly, embodying the principles of the invention is illustrated in FIGS. 8–9. As illustrated in FIG. 9, tip 60 includes a plug-like body portion 62 having a contoured outer surface 64 and is disposed at an end of tubular member 24. Body portion 62 includes an upper surface 66 and a lower surface 68.

As illustrated in FIG. 8, base 400 includes a body portion 402 having an upper surface 404 and a lower ground engaging surface 406. An opening 408 is disposed in upper surface 404. Opening 408 is dimensioned such that tip 60 can be received in opening 408. Opening 408 is formed with a side wall portion 410 and a bottom portion (not shown). Base 400 includes mounting holes 414 disposed in upper surface 404.

Base 400 includes a coupler 300 having coupler portions 300*a* and 300*b*. In the illustrated embodiment, coupler portions 300*a* and 300*b* include a body portion 302 having a lip 304 and an inner surface 308. Each of coupler portions 300*a* and 300*b* includes mounting holes 310 adapted to mate with mounting holes 414.

In the illustrated embodiment, the inner surface 308 of coupler 300 has a contour that substantially matches the contour of the outer surface 64 of tip 60. These mating contours provide a frictional engagement between the inner surface 308 and the outer surface 64. Alternatively, the inner surface 308, as well as the outer surface of the tip 60, can be formed without a contoured surface. Moreover, a friction engagement between the inner surface 308 and the outer surface 64 is not required.

Figure 10:
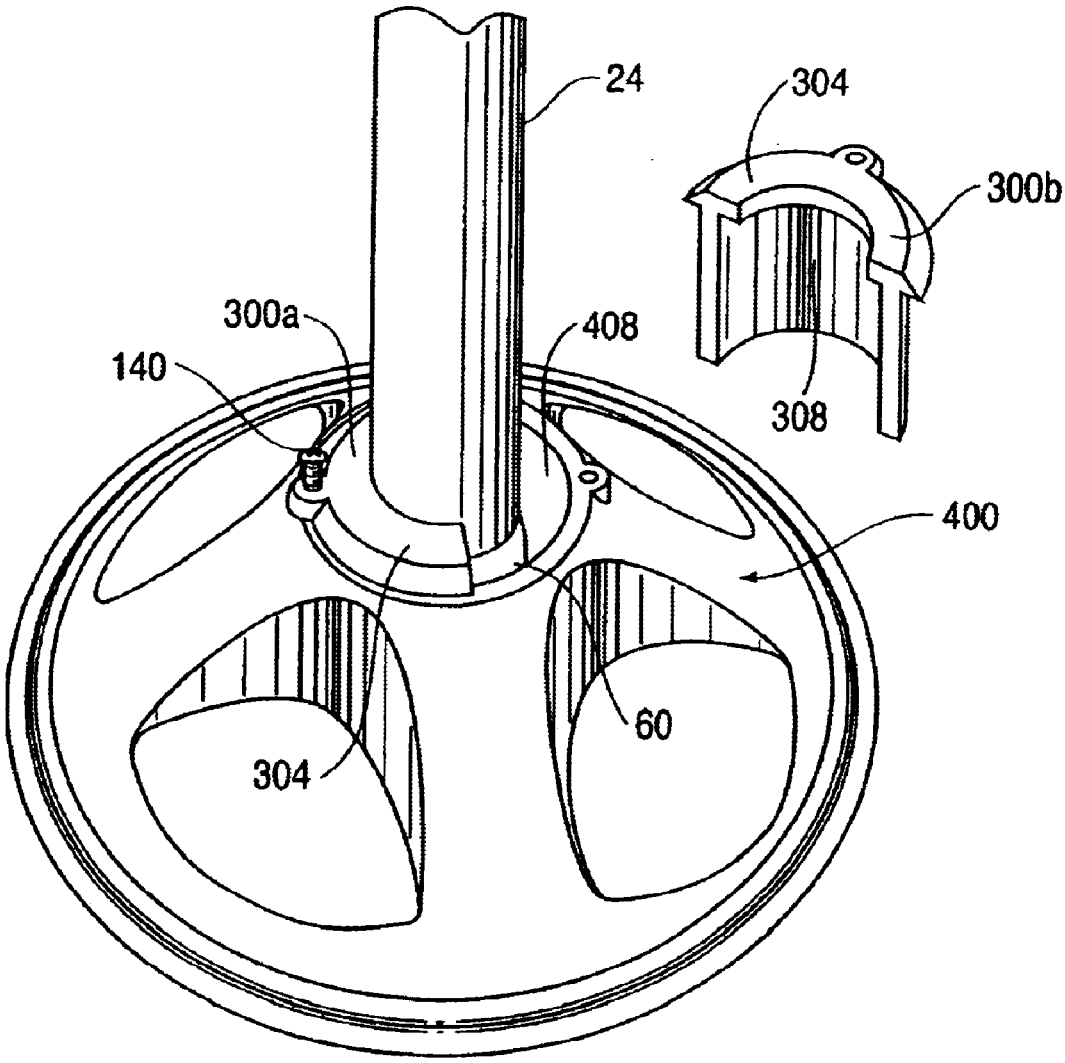
FIGS. 10 and 11 are partial assembled perspective views of the base assembly of FIG. 8.
Figure 11:
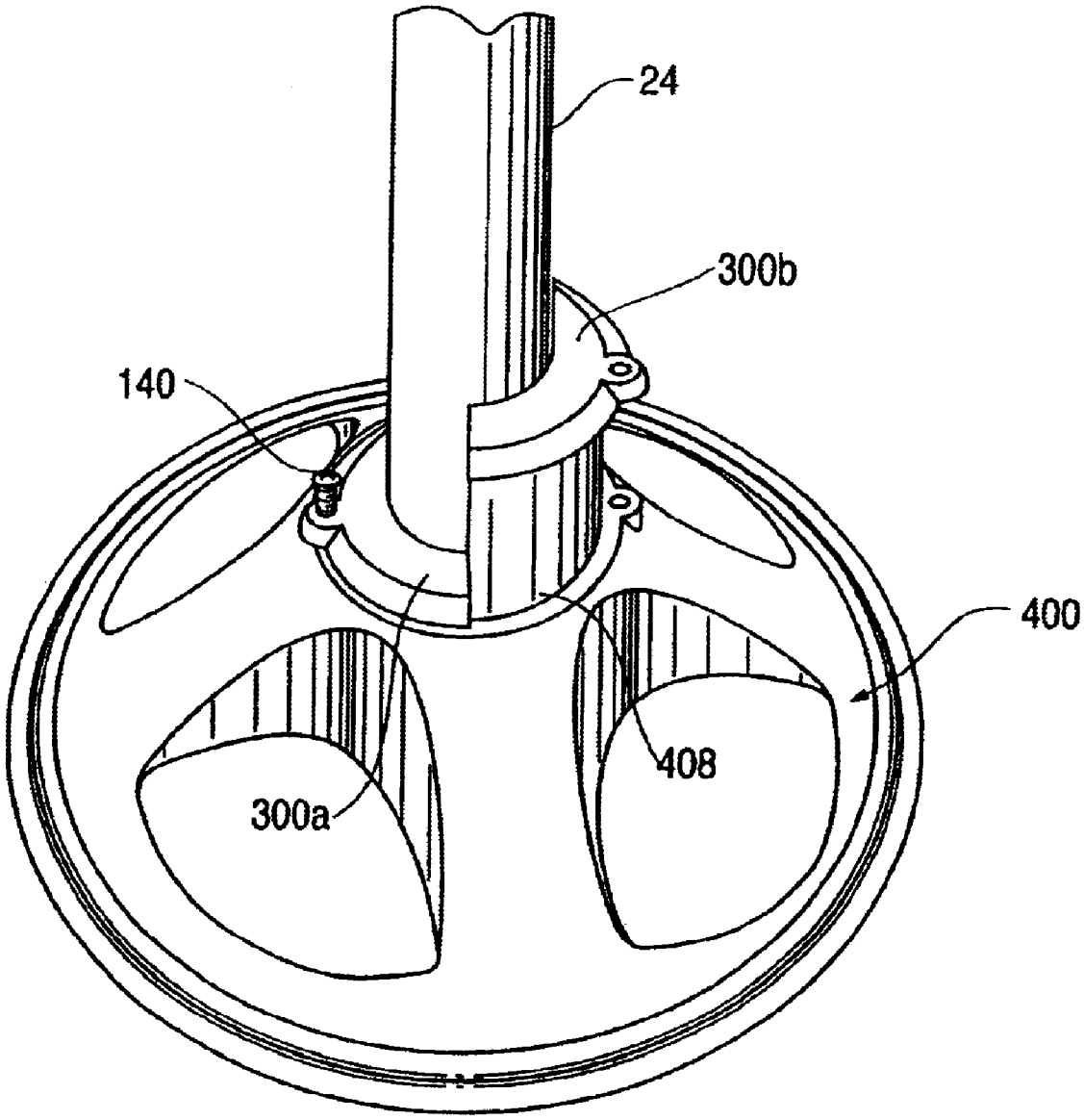

An implementation of the releasable coupling mechanism between the base 400, the coupler 300, and the tip 60 of FIG. 8 is illustrated in FIGS. 10–11. In the illustrated implementation, tip 60 is inserted into opening 408 as shown in FIG. 10. Once tip 60 is inserted into opening 408, then coupler section 300*a* is positioned above and aligned with opening 408 in base 400 and placed into opening 408.

Following placement of coupler section 300*a* into opening 408, coupler section 300*b* is positioned above and aligned with opening 408 in base 400 and placed into opening 408. As coupler sections 300*a* and 300*b* are inserted into the opening 408, the inner surface 308 contacts and frictionally engages the outer surface 64 of tip 60. Once the coupler sections 300*a* and 300*b* are placed into the opening 408, they can be releasably coupled to base 400 using screws 140 or other suitable fastening mechanisms, which also serves to releasably couple tip 60 within opening 408. As described above, in alternative embodiments, coupler 300 can be releasably attached to tubular member 24 and enclose tip 60.

Figure 12:
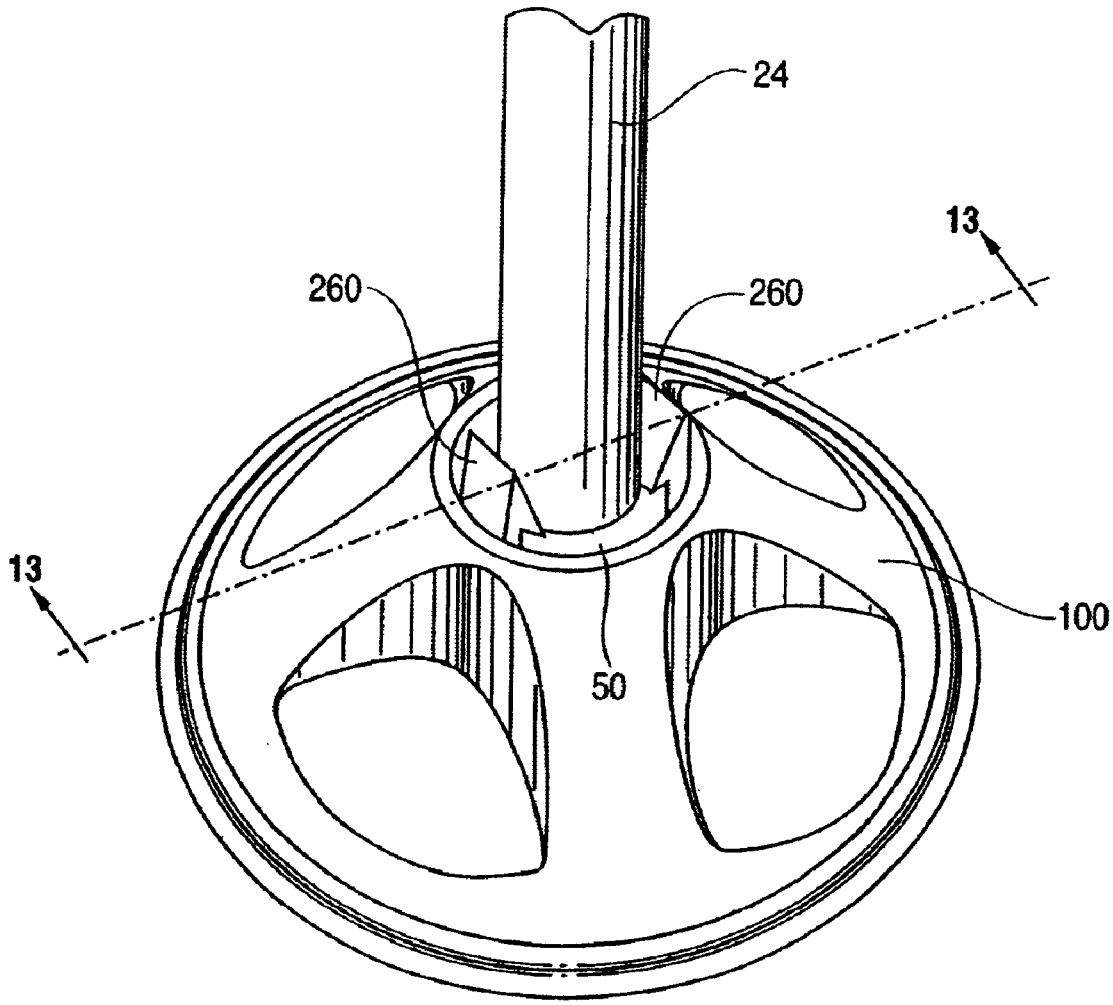
FIG. 12 is a perspective view of an alternative embodiment of the base embodying the principles of the invention.
Figure 13:
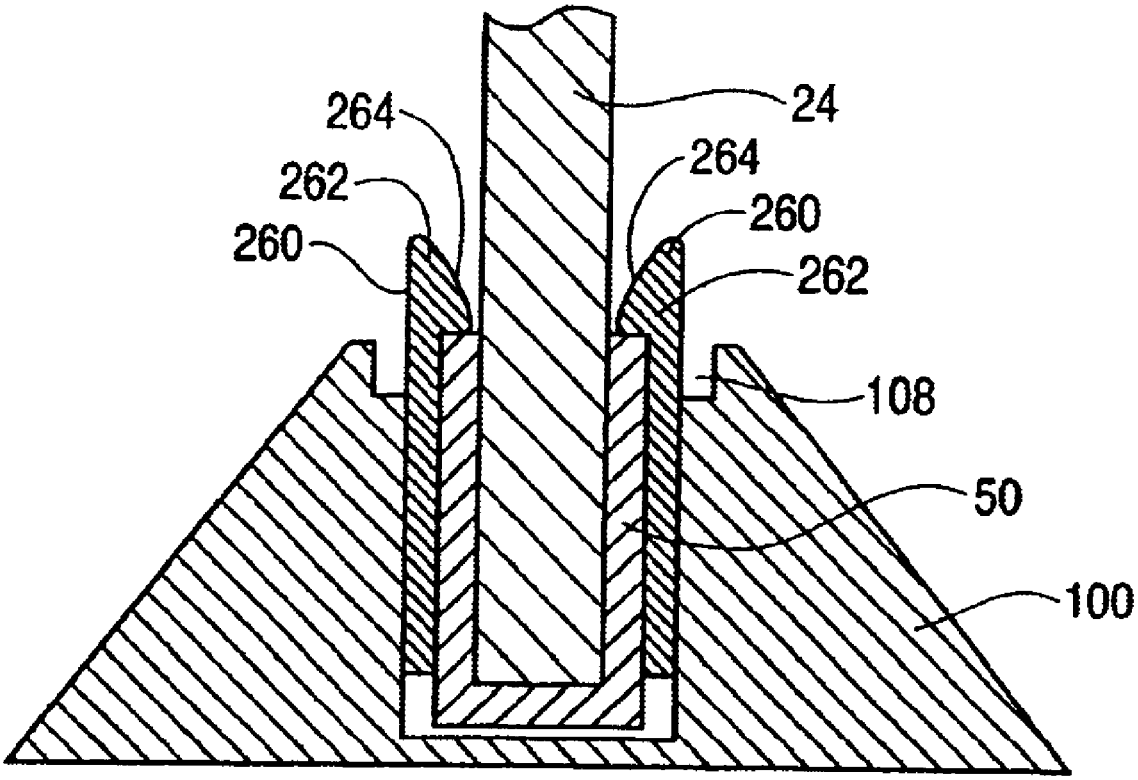
FIG. 13 is a cross-sectional side view of the base of FIG. 12 taken along lines "13—13" of FIG. 12.

An alternative embodiment of a coupler for releasably coupling base 100 to tip 50 is illustrated in FIGS. 12 and 13. FIG. 12 is a perspective view of base 100 including a set of couplers 260 coupled to tip 50.

As best seen in FIG. 13, couplers 260 include a protrusion or tab 262 that extends from the upper surface of the opening 108 formed in base 100. Couplers 260 are integrally formed in opening 108 of base 100. Alternatively, couplers 260 can be formed separate from the base 100 and secured thereto using any conventional fastening technique or mechanism. In the illustrated embodiment, two couplers 260 are shown. In alternative embodiments, any number of couplers 260 could be used, including one coupler 260 having one or more protrusions or tabs 262 formed thereon.

Tabs 262 include an inclined surface 264 that allows for the insertion of tip 50 into the space between the tabs 262. In operation, as the tip 50 is inserted into the opening 108 of base 100 between tabs 262, the inclined surface 264 of tabs 262 moves along the outer surface of tip 50. Once the tip 50 is advanced a sufficient distance, tab 262 snaps against the tubular member 24 and the upper surface of the tip 50. The mechanical engagement between the tabs 262 and the upper surface of the tip 50 releasably engages tip 50 within the opening 108 of base 100. In order to release the engagement, a user simply pulls back on the tabs 262 and removes the tip 50 from the opening 108 formed in base 100.

Figure 14:
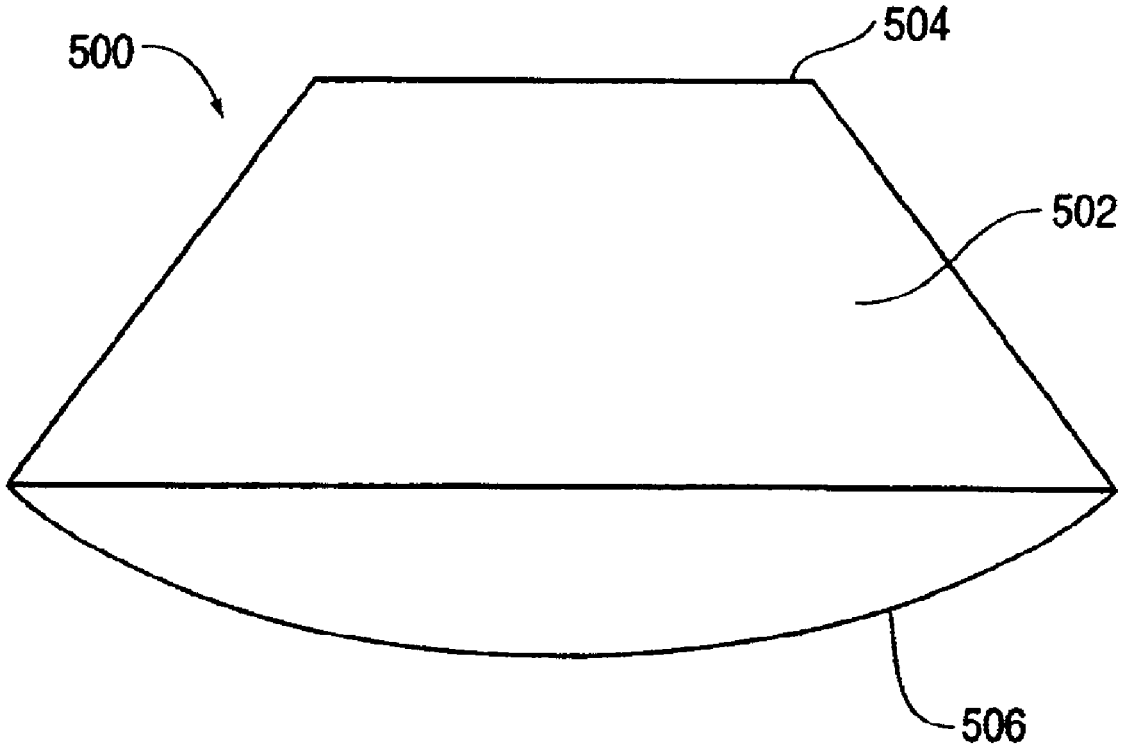
FIG. 14 is a side view of an alternative embodiment of a base embodying the principles of the invention.

An alternative embodiment of the lower ground-engaging surface of the base embodying the principles of the invention is illustrated in FIG. 14. In the illustrated embodiment, base 500 includes a body portion 502. Body portion 502 includes an upper surface 504 and a lower ground engaging surface 506. Surface 506 has a generally circular or hemispherical contact surface.

Figure 15:
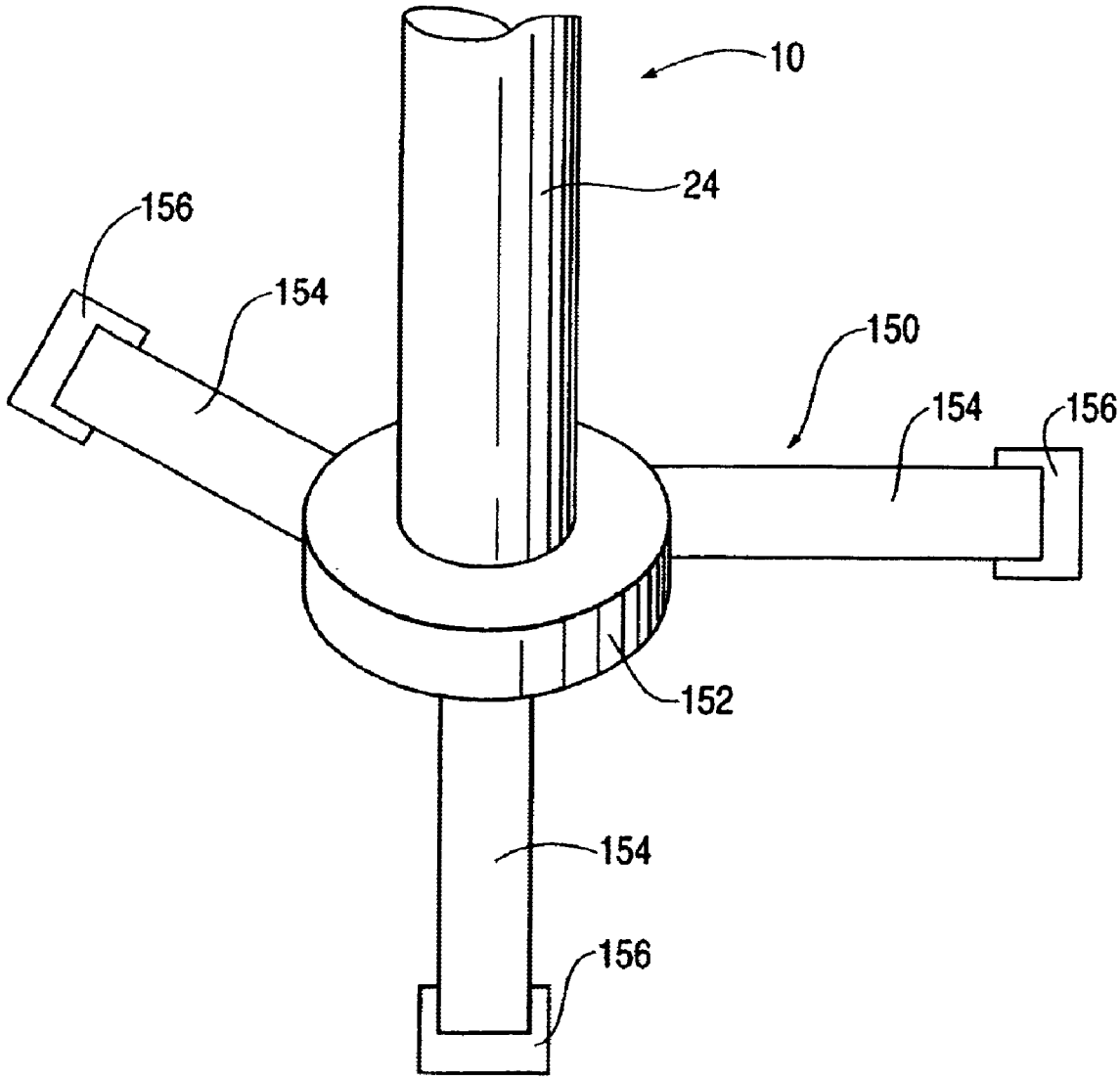
FIG. 15 is a perspective view of a further alternative embodiment of a base embodying the principles of the invention.

An alternative embodiment of a base embodying the principles of the invention is illustrated in FIG. 15. As illustrated, base 150 includes a body portion 152 that can be releasably coupled to tip 50 (not shown) using a coupler as described above. As also described above, a portion or all of tip 50 is disposed within body portion 152 when base 150 is coupled to tip 50.

Body portion 152 includes a plurality of leg members 154 coupled to body portion 152. Leg members 154 can be coupled to body portion 152 using any conventional fastening technique or mechanisms or alternatively, leg members 154 can be formed integrally with body portion 152. Leg members 154 include a foot or ground engaging member or surface 156. Ground engaging members or feet 156 are disposed at or below the lower surface of tip 50 when base 150 is coupled to tip 50. Feet 156 are formed in the shape of a square, however, feet may be formed in any number of applicable geometric shapes, including, but not limited to, circles, triangles and rectangles. Each foot 156 includes a ground engaging surface area including a number of ground engaging contact points. As illustrated in FIG. 15, the ground engaging surface areas and more specifically, the contact points are spaced laterally from the longitudinal axis of tubular member 24 or tip 50.

Unless otherwise indicated herein, it is to be understood that the component parts of the invention are preferably made from a plastic material, such as polypropylene resin, which can be molded and which is sufficiently durable and provides sufficient strength to facilitate its use in the present invention. Other materials, however, such as rubber, aluminum, and the like, could also be employed in the present invention.

Having described the structural features of the disclosed embodiments, attention will now be given to their operation. To operate the pogo stick 10 without the base 100 of the present invention attached, a user steps onto foot-rest 30, grasps handles 40, and begins hopping through successive iterations to progressive positions until the user loses his or her balance. In order to keep one's balance, the user must generally maintain his or her center of gravity over the base tip 50. If the user's center of gravity shifts from this position, then the user must generally step off or falls from the pogo stick 10.

As noted above, many children, especially small children, find using a conventional pogo stick to be extremely difficult or impossible. If the user cannot mount and enjoy and conventional pogo stick, then the user couples the base 100 of the present invention to the tip 50 using the coupler 200 as described above. The base 100 of the present invention includes a ground engaging surface or plurality of surfaces which includes a plurality of ground engaging contact points spaced laterally from the longitudinal axis of the pogo stick 10, and more specifically, the base tip 50 of the pogo stick 10. Having a plurality of contact points spaced laterally from the axis of the base provides added stability to the user because the laterally spaced contact points will compensate for shifts in the user's center of gravity position relative to the longitudinal axis of the stick structure 10.

For example, as a user begins to jump on the pogo stick 10, the stick 10 is generally at a 90-degree angle to the ground surface with the user's center of gravity directly over the base tip 50 of the pogo stick 10 and in line with the longitudinal axis of the stick 10. However, as the user continues to jump, the stick's angle to the ground surface constantly varies and the user tries to compensate for this variation by shifting his or her weight. This change causes the user's center of gravity to move from a point directly over the base tip 50, which eventually results in a loss of balance, unless the user can compensate for the shift. Most users, especially small children cannot compensate for the shift.

With the present invention, however, when the stick's angle to the ground surface tends to shift, the laterally-spaced engagement surface portions of the base 100 contact the ground surface at a point outside the conventional contact area which tends to shift the stick 10 towards the original perpendicular position. This shift allows the user to continue jumping on the stick thereby prolonging the user's enjoyment of the product. The extended base and contact portions also allow a user to mount the pogo stick 10 and easily balance on the stick structure 10 without having to immediately begin jumping on the stick.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

What is claimed is:

1. A pogo stick comprising:

a first tubular member;

a second tubular member disposed parallel to said first tubular member and configured for relative axial movement to said first tubular member;

a handle disposed on said first tubular member;

a foot rest disposed on one of said first tubular member and said second tubular member;

a tip disposed on a lower end of said second tubular member, said tip having a lower surface adapted for contacting a ground surface;

a stabilizer releasably coupleable to said tip, said stabilizer including a body portion, a portion of said body portion enclosing said tip when said stabilizer is coupled to said tip, said body portion adapted for engaging the ground surface at a plurality of ground surface engagement points laterally spaced from a longitudinal axis of said tip, said stabilizer including an opening formed therein, said tip being disposable within said opening when said tip and said stabilizer are coupled together; and a coupler disposable within said opening of said stabilizer and removably coupleable to said stabilizer, said coupler including a body portion and a lip formed on one end of said body portion, said lip adapted to mechanically engage said tip when said tip is disposed within said opening.

2. The pogo stick of claim 1, wherein said body portion includes a plurality of leg members.

3. The pogo stick of claim 1, wherein said stabilizer has a circular and flat body portion.

4. The pogo stick of claim 1, wherein said stabilizer has a frustum-conical shape with a circular ground engaging rim at a lower end of said body portion.

5. The pogo stick of claim 1, wherein said stabilizer has a circular body portion and a recess formed in an upper surface of said stabilizer to receive said tip.

6. The pogo stick of claim 1, wherein said coupler includes a first portion and a second portion removably coupleable to the first portion of the coupler.

7. A pogo stick, comprising:

an elongate member;

a foot rest disposed on said elongate member;

a first ground engaging member having an upper and a lower surface, said first ground engaging member disposed at a lower end of said elongate member;

a second ground engaging member releasably coupleable to said first ground engaging member, said second ground engaging member having a recess formed in an upper surface thereof to receive said first ground engaging member, said second ground engaging member having a contact portion, said contact portion disposed at or below the lower surface of said first ground engaging member when said second ground engaging member is coupled to said first ground engaging member, said contact portion including a plurality of ground engaging contact points spaced laterally from an axis of said first ground engaging member; and a coupler including a first portion and a second portion removably coupleable to the first portion of the coupler, said coupler disposable on said second ground engaging member.

8. The pogo stick of claim 7 wherein, said coupler includes a body portion and a rim formed on one end of said body portion, said rim is adapted to engage said first ground engaging member.

9. The pogo stick of claim 8, wherein said first around engaging member includes a contoured outer surface.

10. The pogo stick of claim 9, wherein said coupler includes a contoured inner surface, said contoured inner surface of said coupler configured to engage substantially all of said contoured outer surface of said first ground engaging member to frictionally engage said coupler to said first ground engaging member.

11. The pogo stick of claim 7, further comprising:

an annular ring disposed on said first ground engaging member, said coupler having an inner surface and an outer surface, said inner surface including an annular groove formed therein and configured to receive a portion of said annular ring.

12. The pogo stick of claim 7, wherein said second ground engaging member includes a plurality of leg members each having a ground engaging portion.

13. The pogo stick of claim 12, wherein said ground engaging portions are disposed symmetrically about said axis.

14. The pogo stick of claim 7, wherein said contact portion is circular and flat.

15. The pogo stick of claim 7, wherein said second ground engaging member has a frustum-conical shape and said contact portion has a circular ground engaging rim at a lower end thereof.

16. The pogo stick of claim 7, wherein said second ground engaging member has a circular contact portion.

17. A pogo stick for use on a ground surface, comprising:

an elongate pole;

a foot rest disposed on said elongate pole;

a tip disposed at a lower end of said elongate pole, said tip having a lower surface for contacting the ground surface, said lower surface of said tip having a first contact surface area;

a base releasably coupleable to said lower end of said elongate pole, said base having a recess in an upper surface of said base to receive said tip, said base including a lower surface for contacting the ground surface and an upper surface for releasably coupling said base to said pole, said lower surface of said base having a second contact surface area, said second contact surface area being larger than said first contact surface area; and a coupler including a first portion and a second portion removably coupleable to said first portion of the coupler, the coupler being coupleable to said base.

18. The pogo stick of claim 17, wherein said coupler is adapted to releasably engage said tip.

19. The pogo stick of claim 18, wherein said coupler includes a protrusion having an inclined surface, said coupler adapted to mechanically engage said tip.

20. The pogo stick of claim 17, further comprising:

a coupler including a sleeve portion and a rim formed about an end of said sleeve portion, said coupler coupleable to said base such that said rim of said coupler engages said tip to releasably couple said base to said tip.

21. The pogo stick of claim 17, wherein said lower surface is circular and flat.

22. The pogo stick of claim 17, wherein said base has a frustum-conical shape with a circular ground engaging rim formed on said lower surface.

23. The pogo stick of claim 17, wherein said base has a circular lower surface.

24. A pogo stick, comprising:

an elongate member;

a foot rest disposed on said elongate member;

a first ground engaging member having an upper surface, a lower surface, and an annular ring, said first ground engaging member disposed at a lower end of said elongate member;

a second ground engaging member releasably coupleable to said first ground engaging member, said second ground engaging member having a contact portion, said contact portion disposed at or below the lower surface of said first ground engaging member when said second ground engaging member is coupled to said first ground engaging member, said contact portion including a plurality of ground engaging contact points spaced laterally from an axis of said first ground engaging member; and a coupler removably coupleable to said second ground engaging member, said coupler having an inner surface and an outer surface, said inner surface including an annular groove formed therein and configured to receive a portion of said annular ring.

25. The pogo stick of claim 24, wherein said second ground engaging member includes a plurality of leg members each having a ground engaging portion.

26. The pogo stick of claim 24, wherein said grounding engaging portions are disposed symmetrically about said axis.

27. The pogo stick of claim 24, wherein said contact portion is circular and flat.

* * * * *

UNITED STATES PATENT AND TRADEMARK OFFICE

CERTIFICATE OF CORRECTION

PATENT NO. : 6,964,634 B2
APPLICATION NO. : 09/976837
DATED : November 15, 2005
INVENTOR(S) : Mark Wojtkiewicz et al.

It is certified that error appears in the above-identified patent and that said Letters Patent is hereby corrected as shown below:

Column 8,
Line 63, replace “around” with --ground--.

Column 10,
Line 39 replace “grounding” with --ground--.

Signed and Sealed this

Third Day of October, 2006

JON W. DUDAS
*Director of the United States Patent and Trademark Office*